United States Patent [19]

Marton et al.

[11] 4,372,495

[45] Feb. 8, 1983

[54] PROCESS AND APPARATUS FOR COMMINUTING USING ABRASIVE DISCS IN A DISC REFINER

[75] Inventors: Renata Marton, Syracuse; Alton F. Brown, Cazenovia, both of N.Y.

[73] Assignee: The Research Foundation of State University of New York, Albany, N.Y.

[21] Appl. No.: 144,019

[22] Filed: Apr. 28, 1980

[51] Int. Cl.[3] ..... B02C 7/12

[52] U.S. Cl. ..... 241/28; 241/261.2; 241/298

[58] Field of Search ..... 241/28, 18, 23, 65, 241/296, 298, 261.2, 261.3, 251; 51/206.4, 206.5, 206 R

[56] References Cited

U.S. PATENT DOCUMENTS

| | | | |
|---|---|---|---|
| 3,117,603 | 1/1964 | Van Keuren et al. | 241/298 |
| 3,622,091 | 11/1971 | Bidwell | 51/206.5 X |
| 4,023,737 | 5/1977 | Leider et al. | 241/298 X |
| 4,023,739 | 5/1977 | Lampe et al. | 241/296 |
| 4,090,672 | 5/1978 | Ahrel | 241/296 X |

OTHER PUBLICATIONS

"Grinding Equipment", Mechanical Pulping Manual, Tappa, Monograph Series-No. 21, New York, N.Y. 1960.

"Pulpstones for Mechanical Pulp", Gavelin, N.G., Science and Technology of Mechanical Pulp, p. 67, 1966.

*Primary Examiner*—Mark Rosenbaum
*Attorney, Agent, or Firm*—Michael L. Dunn

[57] ABSTRACT

An apparatus for comminuting a substance which comprises a rotatable disc having a disintegrating surface and a base surface proximate to and facing the disintegrating surface. The apparatus has a means for rotating the disc and for feeding particles of the substance between the disintegrating surface and base surface. At least one of the disintegrating surface and base surface comprise an abrasive and at least one of the base surface and disintegrating surface comprise breaker bars. The invention also includes a novel disc for use in a disc refiner having an abrasive disintegrating surface and a novel comminuting plate for use as part of such a disc. The apparatus also desirably comprises a means for elevating the temperature of the substance being comminuted and desirably comprises a means for pressurizing the environment surrounding the substance being comminuted especially when the substance is wet wood chips and the desired product is fiberized wood pulp. The invention also includes a process for comminuting a substance by feeding particles of the substance into the apparatus and wood pulp made by the process.

28 Claims, 2 Drawing Figures

PROCESS AND APPARATUS FOR COMMINUTING USING ABRASIVE DISCS IN A DISC REFINER

BACKGROUND OF THE INVENTION (A) Field of the Invention

This invention relates to comminuting utilizing disc refiners and especially relates to the formation of wood pulp by comminuting wood chips.

(B) History of the Prior Art

Ground wood for use as wood pulp is currently being produced by two different methods. One comprises the fiberization of wood logs by grinding with a rotating stone within an abrasive surface, while in the other method, wood is first reduced to chips and then fiberized in disc refiners. Depending upon the desired quality of ground wood, 80 to 100 horsepower days per ton of power is consumed in the production of ground wood using either the stone or the disc refiner method. However, only a fraction of this energy is used for the liberation of the fibers from the wood log or chip; the rest is dissipated as heat or lost in other ways.

It is also known that hard woods do not yield an acceptable quality of ground wood, at least partly because of the greater slenderness of their fibers in comparison with the fibers of soft woods and the higher density and brittleness of the hard woods. Because of this brittleness and small fiber diameter, the particles torn out of the hard wood log by the stone grinder or shaved off from the chips by the bars of the disc refiner plates tend to form rather coarse particles containing layers of many fibers as well as very small particles forming "fines."

One type of mechanical pulp is made in disc refiners under pressure, the product being known as thermo or thermal mechanical pulp (TMP). This process allows the production of mechanical pulp of much higher quality than other mechanical pulping methods, but it consumes 30 to 50 percent more energy than standard methods.

Thermal mechanical pulp is made from wood chips a majority, having a size in maximum dimension of from ⅜ to 1 inch. In conventionaloperations, plates of various breaker bar patterns are mounted on the solid backing disc of the refiners, which rotate in opposite direction and by attrition reduce the wood chips to a coarse fibrous mass. The product of this first stage is not yet ready for paper production and has to be refined once more in a second stage which is also a disc refiner. This time the refining is done under atmospheric pressure to achieve the final quality. The grinding surface of the discs of the prior art all consist essentially of breaker bars arranged in various patterns.

BRIEF DESCRIPTION OF THE INVENTION

Figure 1:
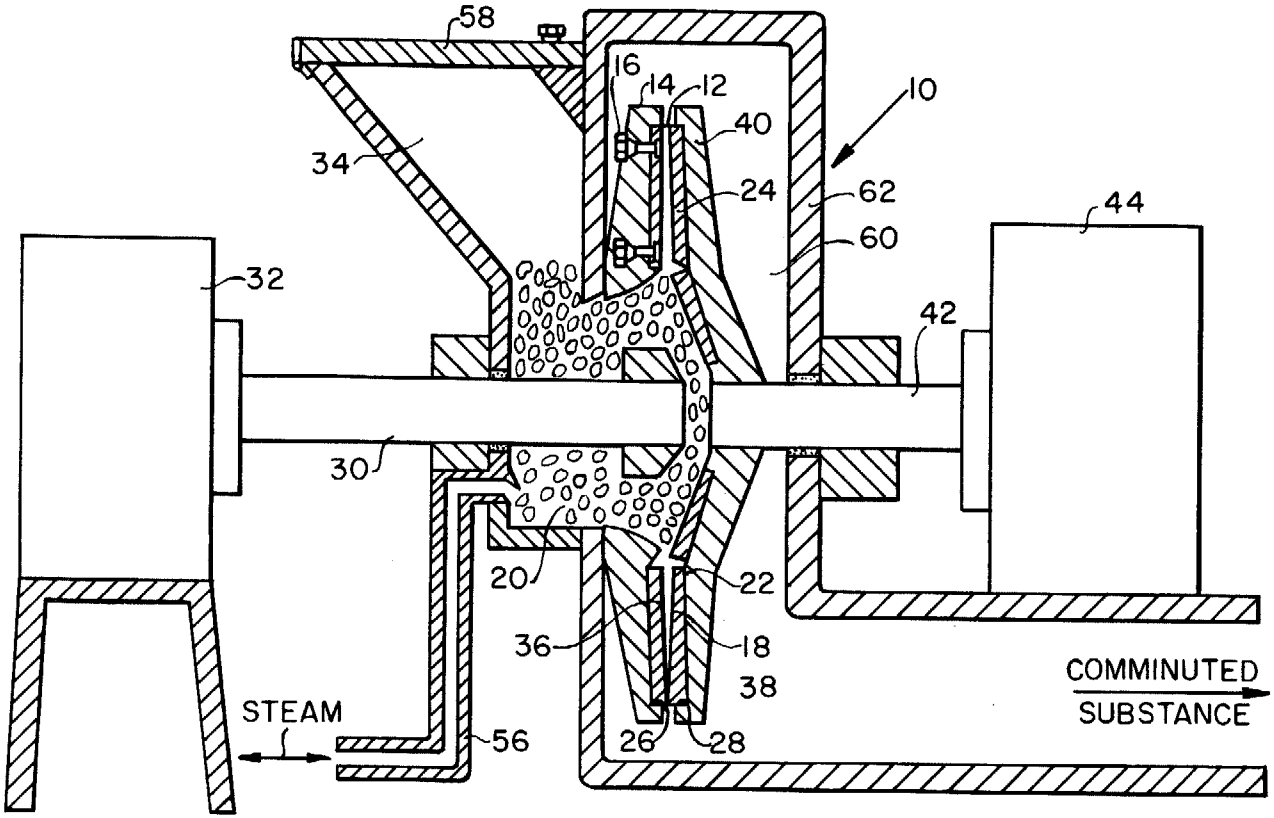
FIG. 1 is a side cross sectional view of a comminuting apparatus of the invention .

It has now been discovered in accordance with the present invention that high quality mechanical pulp can be obtained using a disc refiner but with much lower energy than prior art pressurized methods.

In accordance with the present invention, a novel mechanical comminuting disc refiner is used which can be used not only for comminuting wood to form excellent wood pulp but to comminute other substances especially fiber containing substances to form fiber pulps from materials other than wood. The apparatus can, however, also be used to disintegrate or comminute any substance which is solid at the comminuting temperature.

The apparatus, in accordance with the invention for mechanically comminuting a substance which is solid at the comminuting temperature, comprises a first rotatable disc having a disintegrating surface and a base surface proximate to and facing the disintegrating surface. Means are provided for rotating the disc and for feeding particles of the substance between the disintegrating surface and the base surface.

At least one of the disintegrating surface and the base surface comprise an abrasive and at least one of the disintegrating surface and the base surface comprising breaker bars. The base surface and disintegrating surface must, of course, be harder than the substance being comminuted and the surfaces should be separated along at least a portion of the surfaces by a distance of from 0 to 1 millimeters. Desirably, each of the breaker bars on the disintegrating surface or base surface should be oriented such that the longitudinal axis of each of the bars is in a plane approximately perpendicular to any circle of the disc at the intersection of the longitudinal axis with the circle. "Approximately perpendicular" as used herein means within 30 degrees of perpendicular. A circle of the disc is intended to mean any circle lying in the plane of the surface of the disc and having its center at the center of the disc.

A means for elevating the temperature of the substance being comminuted is also very desirable, especially when the substance is wood chips. The means for elevating the temperature of the substance may simply be the means for disintegrating the substance since large quantities of frictional heat is released. If desired, a supplemental heat source may be provided, e.g., in the form of steam.

When the substance is wood and the desired product is fiberized wood pulp, the wood should contain from 35 to 75 weight percent water. When wet wood is used at an elevated temperature, i.e., between above 100° and 170° C., a means for pressurizing the environment surrounding the substance, e.g., wood, is needed to retain the water in the form of pressurized steam. The desired pressure is usually from about 1.2 to 8 kilograms per square centimeter absolute.

The invention also includes the novel disc for use in a mechanical disc refiner which has an abrasive disintegrating surface and mechanical comminuting plate for use as a part of such a disc which comprises a truncated circular sector having a disintegrating surface which surface is divided by an arc of the circle of the sector into adjacent inside and outside surfaces, the inside surface of which is provided with a series of integral breaker bars, each of which has a longitudinal axis essentially parallel with the nearest diameter of the circle of the sector and the outside comprising an abrasive. "Essentially parallel" as used in this context means within 30 degrees of parallel.

The process of the invention comprises feeding particles of the substance to be comminuted into the apparatus of the invention and further includes a wood pulp formed by mechanically fiberizing and disintegrating wood by feeding wood chips into the apparatus of the invention. The apparatus of the invention permits production of a finished thermal mechanical wood pulp of quality comparable to thermal mechanical pulp manufactured under pressure using conventional disc configurations but consumes 30 to 50 percent less energy than prior art methods. Furthermore, the production rate utilizing the apparatus and process of the invention is substantially higher than the production rate obtained when conventional discs are used.

DETAILED DESCRIPTION OF THE INVENTION

As previously discussed, the invention includes an apparatus for mechanically comminuting a substance. The substance is solid at the comminuting temperature and is preferably wood but may be other substances, especially fiber containing substances such as paper or rags. The substance may also be a composition which is not generally considered fibrous such as leather, a thermoset plastic or a soft metal such as aluminum or copper. The apparatus and process of the invention is especially suitable for wood including both soft and hard woods in the form of chips a majority having a maximum dimension of between about ½ and 1 inch and preferably between ⅝ and ¾ of an inch.

The comminuting temperature, especially when the substance is wood, is preferably between above 100° to about 170° C. and most preferably between 110° to 160° C.

To obtain the elevated temperature, especially when water is present, the apparatus should include a means for pressurizing the environment surrounding the substance, e.g., wood to prevent water within the wood from escaping at the comminuting temperature which is desirably above the boiling point of water at atmospheric pressure. Also, when wood is the substance, a means may be provided for actually increasing the water content of the wood. Usually, when the substance is wood, the means for elevating the temperature and the means for pressurizing the environment are at least partially included within a means for surrounding the chips with pressurized steam.

The means for surrounding the chips with pressurized steam may be a means for sealing the area containing the wood chips being comminuted and retaining at least a portion of the steam liberated from wet chips by frictional heat generated as the chips are ground. So much steam may be generated that it may be recovered for other uses thus reducing overall energy costs. Wood which is used in this application for forming wood pulp should contain from 35 to 75 weight percent water.

The means for rotating the disc can be any suitable rotating means but is generally a shaft connected between the center of the disc and an electric motor. Other connecting means between a motor and the disc may be used such as gears, belts or chains.

The means for feeding particles of the substance between the disintegrating surface and the base surface again may be any suitable means. Such means may include for example, a hopper containing particles of the substance which is connected to a location between the discs by means of a connecting tube thus permitting particles to fall from the hopper through the tube by gravity to a location between the disintegrating surface and the base surface. Another means may include a screw feeder for feeding particles of the substance to a location between the disintegrating surface and the base surface. When the grinding area, i.e., the area between the disintegrating surface and the base surface, is pressurized, the feeding means may also be optionally be pressurized to prevent pressure from escaping through the feeding means to the atmosphere or a valve may be incorporated in the feeding means to prevent the escape of pressure.

The disintegrating surface is always harder than the substance being comminuted as is the base surface and the base surface and disintegrating surface are separated along at least a portion of the surfaces by a distance of from 0 to 1 millimeter. At least one of the disintegrating surface and the base surface comprises an abrasive which is usually a medium grit abrasive in the case where the substance being comminuted is wood chips. By medium grit is meant a grit size of between about 40 and 120 grit, i.e., an average particle size of between about 600 and about 140 micrometers. Larger particle sizes, e.g., up to about 12 grit or about ¼ centimeter can be used. The abrasive may be a ceramic material. The ceramic material may be selected from silica, alumina, silicon carbide, zirconia and tungsten carbide.

As previously mentioned, at least one of the disintegrating surface and the base surface comprises breaker bars. Each of the bars has a longitudinal axis which is in a plane approximately perpendicular to a circle of the disc at the intersection of the longitudinal axis with the circle. A circle of the disc is any circle lying within the disc surface and having its center at the center of the disc. Another way of indicating the orientation of the breaker bars is that the longitudinal axis of each bar is essentially parallel with the nearest diameter of any circle of the disc. The bar itself projects from the surface in a plane essentially perpendicular to the arc of rotation of the disc. When the disc comprises a plurality of plates having truncated circular sectors, a circle of the sector and a circle of the disc should be considered identical.

The disc does, in fact, preferably comprise a plurality of plates each of which comprises a truncated sector having a disintegrated surface. The disintegrating surface is preferably divided by an arc of the circle of the sector into adjacent inside and outside surfaces. The inside surface is provided with a series of integral breaker bars, each of which has a longitudinal axis essentially parallel with the nearest diameter of the circle of the sector in a plane essentially perpendicular to the arc of rotation of the disc as previously described and the outside surface of which comprises an abrasive.

The invention independently comprises a mechanical comminuting disc for use in a mechanical disc refiner as previously described.

The invention also independently comprises a mechanical comminuting plate for use as part of a mechanical comminuting disc as previously described.

In general, the breaker bars of the disc or plates protrude to a height equal to from one tenth to one-half of the thickness of the plate or disc. Usually when the disc comprises a series of comminuting plates in the shape of a circular sector, the sector has an outside edge in the form of a 60° arc. When the plate is divided into inside and outside surfaces as previously described, the outside surface preferably has from about 1.5 to about 2.5 times the area of the inside surface.

The base surface may comprise the surface of a grinding stone or may comprise the disintegrating surface of a second rotatable disc. When a second rotatable disc is provided, a means is also provided for rotating the second rotatable disc in a direction opposite to the rotation of the first rotatable disc. The means for rotating the second rotatable disc may be any suitable rotating means such as a motor directly connected by a shaft to the center of the second rotatable disc or a motor connected by any other suitable connecting means to the disc.

The invention also includes wood pulp manufactured in accordance with the process of the invention which pulp has characteristics similar to, but not identical with, the best thermal mechanical wood pulps manufactured in accordance with the high energy processes of the prior art.

Referring now to the drawings, as best illustrated in FIG. 1, the apparatus 10 in accordance with the invention comprises a first rotatable disc 12 which is secured to a disc back plate 14 by means of bolts 16. Disc 12 has a disintegrating surface 18 which is harder than the substance 20 being comminuted. A base surface 22 is provided which preferably comprises a second disc 24. The base surface 22 is proximate to and faces disintegrating surface 18 of disc 12. Base surface 22 is similarly harder than substance 20 being comminuted. The surfaces 18 and 22 are separated along at least a portion of the surfaces by a distance of from 0 to 1 millimeters preferably proximate the outer edges 26 and 28 of discs 12 and 24 respectively.

The means for rotating disc 12 comprises a means for rotating disc back plate 14 to which disc 12 is secured. Disc back plate is rotated by means of shaft 30 which is connected to motor 32. The means for feeding particles of substance 20 between disintegrating surface 18 and base surface 22 comprises a hopper 34 into which particles of substance 20 are fed. From hopper 34, substance 20 falls by gravity to a location at the center of disc 12. Rotational force then causes substance 20 to move between disintegrating surface 22 and base surface 18.

Figure 2:
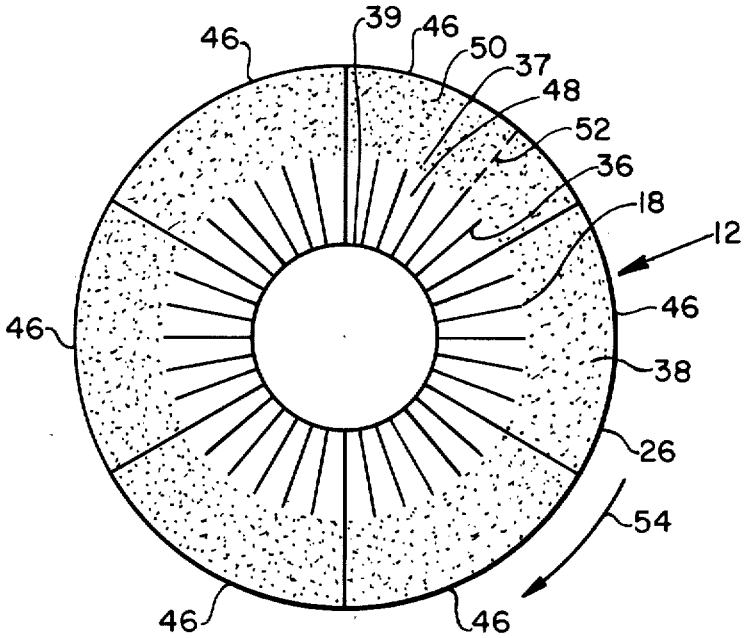
FIG. 2 is a front view of a comminuting disc of the invention.

In the preferred embodiment, disintegrating surface 18 comprises breaker bars 36 which are best seen in FIG. 2. Each of the breaker bars 36 have a longitudinal axis in a plane approximately perpendicular to a circle of the disc at the intersection of the axis with the circle. A circle of the disc is any circle lying in the plane of the disc having its center at the center of the disc. The disc also preferably has an abrasive surface 38 which preferably lies nearer to end 26 of disc 12 than breaker bars 36.

The base surface may, in an alternative embodiment, comprise the surface of a grinding stone which may either be stationary or may rotate. As shown in FIG. 1, base surface 22 comprises the disintegrating surface of a second rotatable disc 24 which is secured to a second back plate 40. Means is provided for rotating the second rotatable disc 24 in a direction opposite to the rotation of first rotatable disc 12. The means comprises shaft 42 connected to disc back plate 40 which shaft is in turn connected with second disc motor 44.

Desirably, each of the first rotatable disc and second rotatable disc comprises a plurality of plates 46 as seen in FIG. 2. Each of plates 46 comprising a truncated circular sector having a disintegrating surface 18. The disintegrating surface is divided by arc 37 of the circle of the sector into adjacent inside surface 48 and outside surface 50. The inside surface 48 is provided with a series of integral breaker bars 36, each of which has a longitudinal axis essentially parallel with the nearest diameter 52 of a circle of the sector 37 or 39. In addition, the breaker bar protrudes from disintegrating surface 18 in a plane essentially perpendicular to the arc of rotation 54 of the disc. Outside surface 50 comprises an abrasive.

Especially when substance 20 is wood chips, a means is providing for elevating the temperature of the substance being comminuted to a temperature of from above 100° to about 170° C. When water is present, a means is also provided for pressurizing the environment surrounding the substance being comminuted to from about 1.2 to about 8 kilograms per square centimeter absolute. When the substance is wood containing water, at a concentration of preferably from about 35 to about 75 weight percent, pressurization is necessary to prevent desired water from escaping at temperatures above 100° C. Furthermore, a means is preferably provided for actually increasing the water content of the wood prior to or during comminuting.

As shown in FIG. 1, the means for pressurizing the environment surrounding the wood, elevating the temperature of the substance being comminuted to above 100° to about 170° C. and the means for increasing the water content of the wood comprises a means for supplying pressurized steam to the wood, which may either be steam formed during disintegration of the wood by frictional heat or may be steam supplied from an external source is through a conduit 56. When excessive steam is formed during disintegration, conduit 56 may serve to carry the excess steam from the apparatus. Hopper 34 is sealed by means of lid 58 to retain the desired pressure during disintegration. If desired, the interior 60 of disc casing 62 may also be pressurized with steam or otherwise.

Wood pulp or other comminuted substance is removed from interior 60 of casing 62 by any suitable means such as washing or when a solid product is formed by a solid transfer means such as an auger (not shown).

The following example serves to illustrate but not limit the invention. Unless otherwise indicated, all parts and percentages are by weight.

EXAMPLE

Southern pine chips are converted into thermal mechanical pulp in a comparison of the efficiency of conventional plates having breaker bars versus plates of the invention having an abrasive surface in a pressurized first stage of refining. A two stage process is used wherein, in the second stage, only conventional plates are used at atmospheric pressure. In the first stage, pressurized double disc refiner having a configuration similar to that shown in FIG. 1 is used. Abrasive plates are used in a disc refiner having a configuration similar to that shown in FIG. 2 . On the outside a tungsten carbide grit having an average particle size of about 36 mesh is thermally bonded to provide an abrasive surface. The refiner in the first stage is run at a production rate of 8 to 10 air-dry tons per day at a power of 140 out of 600 available horsepower. Both first stage runs are made with wet chips (55% solids) under 30 psig (about 3 kilograms per square centimeter) pressure allowing three minutes dwelling time in the disc refiner. The machine's speed is 1,200 rpm. For comparison, equal power is applied in corresponding stages. The temperature refining is between about 120° and about 130° C. Table 1 gives typical properties of pulps prepared using conventional versus abrasive plates. As shown in Table 1, at a substantially lower power, pulps prepared using abrasive plates have properties similar to the properties of pulps obtained using conventional disc refiner plates.

TABLE 1

Properties of Southern Pine Ground Pulps Prepared in Conventional and Abrasive Plates

| Plates in 1st Stage (Pressurized) | Conventional | Abrasive |
|---|---|---|
| Plates in 2nd Stage (Atmospheric) | Conventional | Conventional |
| Total BHPD/ADT* in 1st Stage | 105.6 | 87.5 |
| Canadian Standard Freeness ml | 94 | 92 |
| Bulk Density $cm^3/g$ | 3.0 | 2.8 |
| Burst Factor | 14.6 | 15.0 |
| Breaking Length, m | 3250 | 3400 |
| Tear Factor | 90 | 85 |
| Stretch % | 2.7 | 2.2 |
| Brightness, % | 52.8 | 53.5 |
| Scattering Coefficient $m^2/kg$ | 52.9 | 51.7 |

*Brake horsepower day per air dry ton

What is claimed is:

1. A mechanical comminuting plate for use as a part of a mechanical comminuting disc, said plate comprising a truncated circular sector having a disintegrating surface, said surface being divided by an arc of the circle of the sector into adjacent inside and outside surfaces, the inside surface of which is provided with a series of integral breaker bars each of which has a longitudinal axis essentially parallel with the nearest diameter of the circle of the sector and said outside surface comprising an abrasive having an average particle size of between about 140 micrometers and ¼ centimeter.

2. The mechanical comminuting plate of claim 1 wherein the area of the outside surface has from about 1.5 to about 2.5 times the area of the inside surface.

3. The plate of claim 1 wherein the bars protrude to a height equal to from to one-tenth to one-half of the thickness of the plate.

4. The plate of claim 3 wherein the circular sector has an outside edge in the form of a 60° arc.

5. The plate of claim 3 wherein the area of the outside surface is from 1.5 to 2.5 times the area of the inside surface.

6. The plate of claim 3 wherein the abrasive is a ceramic material selected from the group consisting of silica, alumina, silicon carbide, zirconia and tungsten carbide.

7. The plate of claim 6 wherein the abrasive has a grit size of between about 40 and 120 grit.

8. An apparatus for mechanically comminuting a substance which is solid at the comminuting temperature which apparatus comprises a first rotatable disc having a disintegrating surface; a base surface proximate to and facing said disintegrating surface, said base surface and said disintegrating surface being harder than the substance being comminuted and said surfaces being separated along at least a portion of said surfaces by a distance of from 0 to 1 millimeters; a means for rotating said disc and means for feeding particles of said substance between the disintegrating surface and the base surface, at least one of the disintegrating surface and the base surface comprising an abrasive having an average particle size of between 140 micrometers and ¼ centimeter, and at least one of the disintegrating surface and the base surface comprising breaker bars, each of said bars having a longitudinal axis in a plane approximately perpendicular to a circle of the disc at the intersection of the axis with the circle, said disc comprising a plurality of plates, the combined surfaces of which form said disintegrating surface.

9. The apparatus of claim 8 wherein the base surface comprises the surface of a grinding stone.

10. The apparatus of claim 8 wherein the base surface comprises the disintegrating surface of a second rotatable disc.

11. The apparatus of claim 10 wherein means is provided for rotating the second rotatable disc in a direction opposite to the rotation of the first rotatable disc.

12. The apparatus of claim 8 wherein the first rotatable disc comprises an abrasive disintegrating surface.

13. The apparatus of claim 8 wherein each of said plates comprises a truncated circular sector having a disintegrating surface, said disintegrating surface being divided by an arc of the article of the sector into adjacent inside and outside surfaces, the inside surface of which is provided with a series of integral breaker bars each of which has a longitudinal axis essentially parallel with the nearest diameter of the circle of the sector and in a plane essentially perpendicular to the arc of rotation of the disc and the outside surface comprising said abrasive.

14. A process for forming a fiber pulp by mechanically fiberizing and disintegrating a fiber containing substance which process comprises feeding particles of the substance into the apparatus of claim 13.

15. The process of claim 14 wherein the comminuted substance is wood pulp and the particles of the substance are wood chips.

16. The apparatus of claim 8 wherein means is provided for elevating the temperature of the substance being comminuted to a temperature of from above 100° to about 170° C.

17. A process for forming a fiber pulp by mechanically fiberizing and disintegrating a fiber containing substance which process comprises feeding particles of the substance into the apparatus of claim 16.

18. The process of claim 17 wherein the comminuted substance is wood pulp and the particles of the substance are wood chips.

19. The apparatus of claim 16 wherein means is provided for pressurizing the environment surrounding the substance being comminuted to from about 1.2 to about 8 kilograms per square centimeter absolute.

20. A process for forming a fiber pulp by mechanically fiberizing and disintegrating a fiber containing substance which process comprises feeding particles of the substance into the apparatus of claim 19.

21. The process of claim 20 wherein the comminuted substance is wood pulp and the particles of the substance are wood chips.

22. The apparatus of claim 19 wherein the substance is wood chips, and means is provided for increasing the water content of the wood and the means for increasing the water content, the means for elevating the temperature and the means for pressurizing the environment are at least partially included within a means for surrounding the chips with pressurized steam.

23. A process for comminuting a substance by feeding particles of the substance into the apparatus of claim 8.

24. A process for forming a fiber pulp by mechanically fiberizing and disintegrating a fiber containing substance which process comprises feeding particles of the substance into the apparatus of claim 8.

25. The process of claim 24 wherein the comminuted substance is wood pulp and the particles of the substance are wood chips.

26. A mechanical comminuting disc comprising a plurality of adjacent comminuting plates each of said plates comprising a truncated circular sector having a disintegrating surface, said surface being divided by an arc of the circle of the sector into adjacent inside and outside surfaces, the inside surface of which is provided with a series of integral breaker bars each of which has a longitudinal axis essentially parallel with the nearest diameter of the circle of the sector and said outside surface comprising an abrasive having an average particle size of between about 140 micrometers and ¼ centimeters.

27. The mechanical comminuting disc of claim 26 wherein the outside surface has from about 1.5 to about 2.5 times the area of the inside surface.

28. The mechanical comminuting disc of claim 26 wherein the bars protrude to a height equal to from one-tenth to one-half of the thickness of the plate.

* * * * *